US006564579B1

(12) United States Patent
McCartney

(10) Patent No.: US 6,564,579 B1
(45) Date of Patent: May 20, 2003

(54) METHOD FOR VAPORIZING AND RECOVERY OF NATURAL GAS LIQUIDS FROM LIQUEFIED NATURAL GAS

(75) Inventor: Daniel G. McCartney, Overland Park, KS (US)

(73) Assignee: Black & Veatch Pritchard Inc., Overland Park, KS (US)

( * ) Notice: Subject to any disclaimer, the term of this patent is extended or adjusted under 35 U.S.C. 154(b) by 0 days.

(21) Appl. No.: 10/202,568

(22) Filed: Jul. 24, 2002

Related U.S. Application Data

(60) Provisional application No. 60/379,687, filed on May 13, 2002.

(51) Int. Cl.[7] ..... F25J 1/00

(52) U.S. Cl. ..... 62/620; 62/50.2

(58) Field of Search ..... 62/50.2, 620

(56) References Cited

U.S. PATENT DOCUMENTS 3,282,060 A * 11/1966 Hays ..... 62/620
3,420,068 A * 1/1969 Petit ..... 62/50.2
4,753,667 A * 6/1988 O'Connell et al. ..... 62/620

* cited by examiner

*Primary Examiner*—Ronald Capossela
(74) *Attorney, Agent, or Firm*—F. Lindsey Scott

(57) ABSTRACT

A system and process for vaporizing liquefied natural gas (LNG) and separating natural gas liquids from the LNG. The process vaporizes the LNG to produce natural gas meeting pipeline or other commercial specifications. The process in some embodiments uses a closed loop power generation system.

20 Claims, 4 Drawing Sheets

METHOD FOR VAPORIZING AND RECOVERY OF NATURAL GAS LIQUIDS FROM LIQUEFIED NATURAL GAS

RELATED APPLICATIONS

This application is entitled to and hereby claims the benefit of the filing date of U.S. Provisional Application No. 60/379,687 filed May 13, 2002 entitled "Revaporization of LNG in a Receiving Terminal While Conditioning Gas Quality and Recovering Power" by Daniel G. McCartney.

FIELD OF THE INVENTION

This invention relates to a process for separating natural gas liquids from liquefied natural gas (LNG) and using the low LNG temperature to produce power. The process also vaporizes the LNG to produce natural gas meeting pipeline specifications.

BACKGROUND OF THE INVENTION

It is well known that LNG in many instances when vaporized does not meet pipeline or other commercial specifications. The resulting natural gas may have an unacceptably high heating value, which may require dilution of the natural gas with materials such as nitrogen. The separation of nitrogen from the air to produce this diluent adds an expense to the natural gas. Alternatively, natural gas liquids may be removed from the LNG to produce natural gas having a heating value within the specifications for a pipeline. The natural gas liquids (NGLs) typically comprise hydrocarbons containing two or more carbon atoms. Such materials are ethane, propane, butanes and, in some instances, possibly small quantities of pentanes or higher hydrocarbons. These materials are generally referred to herein as $C_2$+ materials. These materials not only add heating value to the natural gas which may increase its heating value beyond specification limits, but they also have greater value in their own right as separately marketable materials. It is desirable in many instances to separate these materials from natural gas prior to vaporizing it for delivery to a pipeline or for other commercial use.

In many instances in the past, LNG has been vaporized by simply burning a portion of the vaporized LNG to produce the heat to vaporize the remainder of the LNG and produce natural gas. Other heat exchange systems have also been used.

These systems require the consumption of substantial energy which may be produced as indicated by consumption of a portion of the product for vaporization, for distillation, for the production of nitrogen for use as a diluent and the like.

Accordingly a considerable effort has been directed toward the development of processes, which are more efficient for accomplishing this objective.

SUMMARY OF THE INVENTION

According to the present invention, it has been found that LNG is readily vaporized and NGLs removed therefrom by a process comprising: vaporizing at least a major portion of a stream of the liquefied natural gas to produce an at least partially vaporized natural gas stream; fractionating the at least partially vaporized natural gas stream to produce a gas stream and a natural gas liquids stream; compressing the gas stream to increase the pressure of the gas stream by about 50 to about 150 psi to produce a compressed gas stream and cooling the compressed gas stream by heat exchange with the stream of liquefied natural gas to produce a liquid compressed gas stream; pumping the liquid compressed gas stream to produce a high-pressure liquid stream at a pressure from about 800 to about 1200 psig; vaporizing the high-pressure liquid stream to produce a conditioned natural gas suitable for delivery to a pipeline or for commercial use; and recovering the natural gas liquids.

It is further been found that the LNG may be vaporized, NGLs may be recovered and substantial power may be recovered from the vaporization and separation process by vaporizing at least a major portion of a stream of the liquefied natural gas to produce an at least partially vaporized natural gas stream; fractionating the at least partially vaporized natural gas stream to produce a gas stream and a natural gas liquids stream; compressing the gas stream to increase the pressure of the gas stream by about 50 to about 150 psi to produce a compressed gas stream and cooling the (compressed gas stream by heat exchange with the stream of liquefied natural gas to produce a liquid compressed gas stream; Pumping the liquid compressed gas stream to produce a high-pressure liquid stream at a pressure from about 800 to about 1200 psig; vaporizing the high-pressure liquid stream to produce a conditioned natural gas suitable for delivery to a pipeline or for commercial use; recovering the natural gas liquids; passing at least one of a first portion and a second portion of a gas heat exchange fluid in heat exchange contact with at least one of the stream of liquefied natural gas and the high-pressure liquid steam to produce a liquid heat exchange fluid; pumping the liquid heat exchange fluid to produce a high-pressure liquid heat exchange fluid; heating the high-pressure liquid heat exchange fluid to vaporize the high-pressure liquid heat exchange fluid to produce a high-pressure gas heat exchange fluid; driving an expander and electric power generator with the high-pressure gas heat exchange fluid to produce electric power and the gas heat exchange fluid; and, recycling the gas heat exchange fluid to heat exchange with the at least one of the streams of liquefied natural gas and the high-pressure liquid stream.

It is further been found that the LNG may be vaporized with the recovery of NGLs and conditioned for delivery to a pipeline or for commercial use by a process comprising: vaporizing at least a major portion of a stream of the liquefied natural gas to produce an at least partially vaporized natural gas stream; separating the at least partially vaporized natural gas stream into a gas stream and a liquid stream; compressing the gas stream to increase the pressure of the gas stream by about 50 to about 150 psi to produce a compressed gas stream; fractionating the liquid stream at a pressure greater than the pressure of the compressed gas stream to produce an overhead gas stream and a natural gas liquids stream; recovering at least a portion of the natural gas liquids stream; combining the overhead gas stream with the compressed gas stream to produce a combined gas stream; cooling the combined gas stream by heat exchange with the stream of liquefied natural gas to produce a liquid stream; pumping the liquid stream to produce a high-pressure liquid stream at a pressure from about 800 to about 1200 psig; and, vaporizing the high-pressure liquid stream to produce a conditioned natural gas stream suitable for delivery to a pipeline or for commercial use.

It has further been found that the natural gas may be vaporized, NGLs recovered and the natural gas resulting from the vaporization of the LNG may be conditioned for delivery to a pipeline or for commercial use with the concurrent generation of electrical power by vaporizing at least a major portion of a stream of the liquefied natural gas to produce an at least partially vaporized natural gas stream; separating the at least partially vaporized natural gas stream into a gas stream and a liquid stream; compressing the gas stream to increase the pressure of the gas stream by about 50 to about 150 psi to produce a compressed gas stream; fractionating the liquid stream at a pressure greater than the pressure of the compressed gas stream to produce an overhead gas stream and a natural gas liquids stream; recovering the natural gas liquids stream; combining the overhead gas stream with the compressed gas stream to produce a combined gas stream; cooling the combined gas stream by heat exchange with the stream of liquefied natural gas to produce a liquid stream; pumping the liquid stream to produce a high-pressure liquid stream at a pressure from about 800 to about 1200 psig; vaporizing the high pressure liquid stream to produce a conditioned natural gas stream; passing at least one of a first portion and a second portion of a gas heat exchange fluid in heat exchange contact with at least one of the liquefied natural gas streams and the high-pressure liquid stream to cool the gas heat exchange fluid to produce a liquid heat exchange fluid; heating the high-pressure liquid heat exchange fluid to a temperature to vaporize the high-pressure liquid heat exchange fluid to produce a high pressure gas heat exchange fluid; driving an expander and electric power generator with the high-pressure gas heat exchange fluid to produce electric power and the gas heat exchange fluid; and, recycling the gas heat exchange fluid to heat exchange with the at least one of the liquefied natural gas stream and the high-pressure liquid stream.

Further, the present invention comprises: a liquefied natural gas inlet line in fluid communication with a liquefied natural gas source and a first heat exchanger; a distillation column in fluid communication with the first heat exchanger and having a gaseous vapor outlet and a natural gas liquids outlet; a compressor in fluid communication with the gaseous vapor outlet and a compressed gas outlet; a line in fluid communication with the compressed gas outlet and the first heat exchanger; and a pump in fluid communication with the first heat exchanger and a second heat exchanger.

The invention further comprises: a liquefied natural gas inlet line in fluid communication with a liquefied natural gas source and a first heat exchanger having a heated liquefied natural gas outlet; a separator vessel in fluid communication with the first heat exchanger and having a separator gas outlet and a separator liquids outlet; a pump in fluid communication with the separator liquids outlet and having a high-pressure liquid outlet; a distillation column in fluid communication with the high-pressure liquid outlet from the pump and having an overhead gas outlet and a natural gas liquids outlet; a compressor in fluid communication with the separator gas outlet and a compressed gas outlet; a line in fluid communication with the compressed gas outlet and the overhead gas outlet to combine the compressed gas and the overhead gas to produce a combined gas stream and to pass the combined gas stream to the first heat exchanger to produce a higher-pressure combined gas liquid stream; and, a pump in fluid communication with the first heat exchanger and a second heat exchanger, the second heat exchanger being adapted to at least partially vaporize the higher-pressure combined gas liquid stream.

The invention further optionally comprises the use of a heat exchange closed loop system in heat exchange with at least one of a charged LNG stream to the process and a conditioned LNG product of the process.

DESCRIPTION OF THE PREFERRED EMBODIMENTS

In the description of the Figures, the same numbers will be used throughout to refer to the same or similar components. Further not all heat exchangers, valves and the like necessary for the accomplishment of the process are shown since it is considered that these components are known to those skilled in the art.

Figure 1:
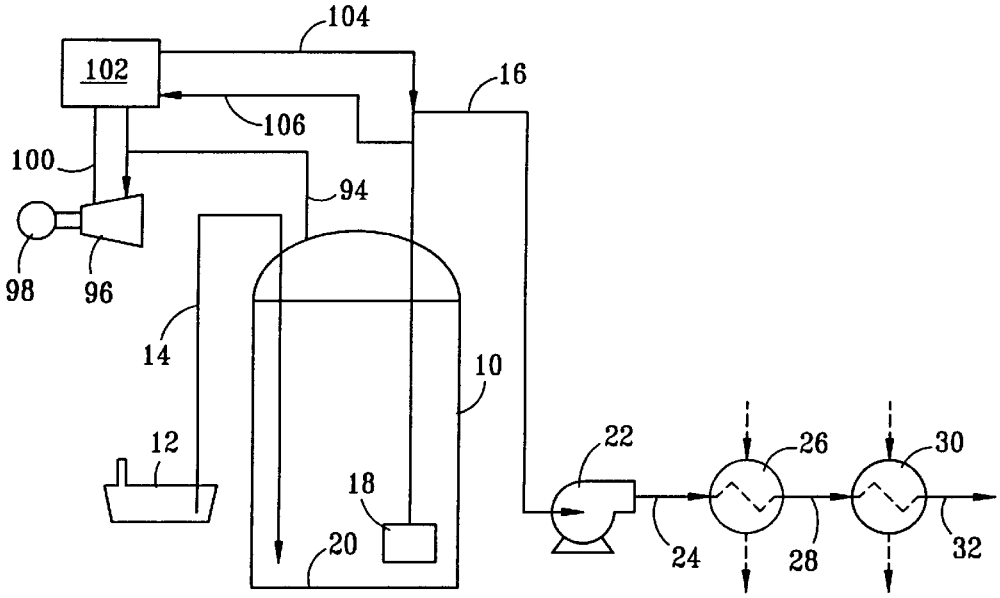
FIG. 1 PRIOR ART
FIG. 1 discloses a prior art process for vaporizing liquefied natural gas.

In FIG. 1 a prior art system for vaporizing LNG is shown. Typically, the processes for vaporizing LNG are based upon a system wherein LNG is delivered, for instance by an ocean going ship, shown at 12, via a line 14 into a tank 10. Tank 10 is a cryogenic tank as known to those skilled in the art for storage of LNG. The LNG could be provided by a process located adjacent to tank 10, by a pipeline or any other suitable means to tank 10. The LNG as delivered inevitably is subject to some gas vapor loss as shown at line 94. This off gas is typically recompressed in a compressor 96 driven by a power source, shown as a motor 98. The power source may be a gas turbine, a gas engine, an engine, a steam turbine, an electric motor or the like. As shown the compressed gas is passed to a boil off gas condenser 102 where it is condensed, as shown, by passing a quantity of LNG via a line 106 to boil off condenser 102 where the boil off gas, which is now at an increased pressure, is combined with the LNG stream to produce an all-liquid LNG stream recovered through a line 104.

As shown, an in-tank pump 18 is used to pump the LNG from tank 10, which is typically at a temperature at about −255 to about −265° F., and a pressure of about 2–5 psig, through a line 16 to a pump 22. Pump 18 typically pumps the LNG through line 16 at a pressure from about 50 to about 150 psig at substantially the temperature at which the LNG is stored in tank 10. Pump 22 typically discharges the LNG into a line 24 at a pressure suitable for delivery to a pipeline. Such pressures are typically from about 800 to about 1200 psig, although these specifications may vary from one pipeline to another. The LNG stream in line 24 is passed to one or more heat exchangers, shown as heat exchangers 26 and 30, for vaporization.

As shown, heat exchangers 26 and 30 are used to vaporize the LNG with a line 28 providing fluid communication between these heat exchangers. The vaporized natural gas is passed via a line 32 to delivery to a pipeline or for other commercial use. Typically the gas is delivered at a pressure of about 800 to 1200 psig or as required by the applicable pipeline or other commercial specifications. Typically the required temperature is about 30 to about 50° F.; although this may also vary.

Heat exchangers 26 and 30 may be of any suitable type. For instance, water or air may be used as a heat exchange media or either or both of these heat exchangers may be fired units or the like. Such variations are well known to those skilled in the art.

As will be observed, if it is required to use a fired heat exchanger, a portion of some fuel must be used to fire the heat exchanger. It will also be noted that there is no opportunity in the conventional vaporization process to adjust the heating value of the natural gas produced by vaporizing the LNG. In other words, if the LNG contains NGLs which frequently occur in natural gas in quantities from at least 3 to about 18 weight percent, then this may cause the resulting natural gas to have heating values higher than permissible in the applicable pipeline or other specifications and as a result it may be required that the natural gas be diluted with an inert gas of some type. As noted previously, nitrogen is frequently used for this purpose but requires that the nitrogen be separated from other air components with which it is normally mixed.

Figure 2:
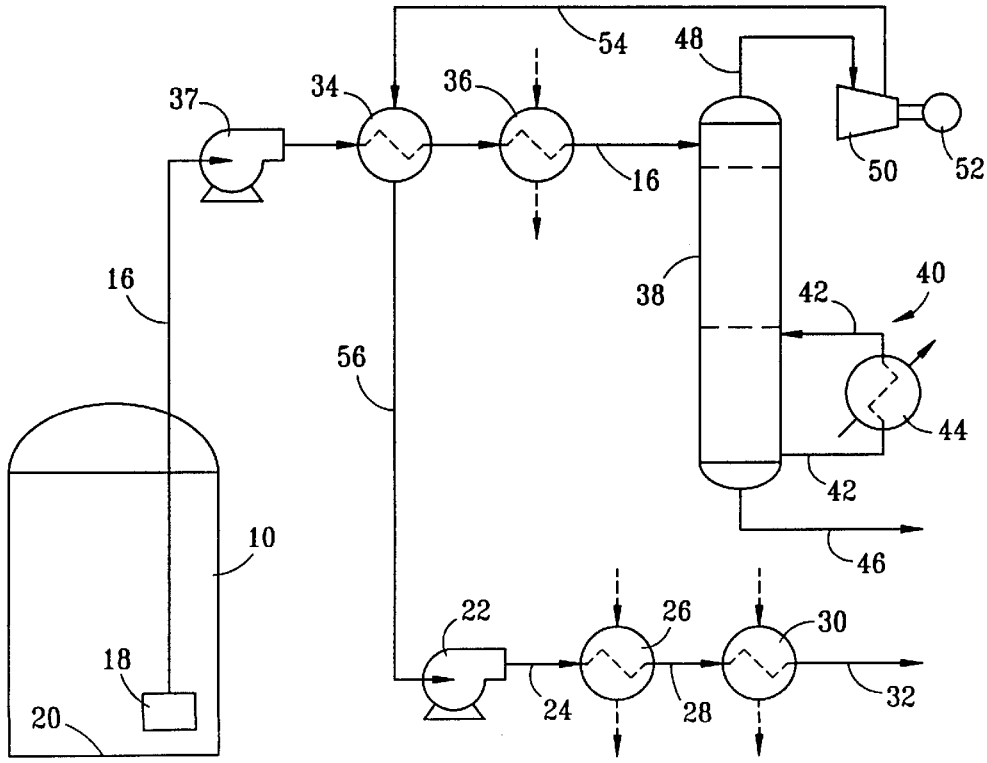
FIG. 2 discloses an embodiment of the present invention.

In FIG. 2, an embodiment of the present invention is shown. In this embodiment, the LNG is typically pumped to a pressure from about 50 to about 150 psig by pump 18 with the pressure being increased to from about 200 psig to about 500 psig by a pump 37 and passed to a first heat exchanger 34. The use of pump 37 is optional if sufficient pressure is available from pump 18. A line 16 conveys the LNG from pump 18 to a distillation vessel 38. A heat exchanger 34 and a second heat exchanger 36 are positioned in line 16 and a pump 37 may also be positioned in line 16, ahead of the heat exchangers, if required to increase the pressure of the LNG stream. Heat exchangers 34 and 36 may be combined into a single heat exchanger if desired. In distillation tower 38, a reboiler 40 comprising a heat exchanger 44 and a line 42 forming a closed loop back to the distillation tower is used to facilitate distillation operations. NGLs comprising $C_2$+ hydrocarbons are recovered through a line 46. Natural gas liquids may contain light hydrocarbons, such as ethane ($C_2$), propane ($C_3$), butanes ($C_4$), pentanes ($C_5$) and possibly small quantities of heavier light hydrocarbons. In some instances, it may be desired to recover such light hydrocarbons as all light hydrocarbons heavier than methane ($C_2$+) or heavier than ethane ($C_3$+) or the like. The present invention is discussed herein with reference to the recovery of ethane and heavier hydrocarbons ($C_2$+), although it should be recognized that other fractions could be selected for recovery if desired.

The NGL recovery temperature may vary widely but is typically from about −25 to about 40° F. The pressure is substantially the same as in distillation vessel 38.

Distillation vessel 38 typically operates at a pressure of about 75 to about 225 psig. At the top of the vessel, the temperature is typically from about −90 to about −150° F. and a gas stream comprising primarily methane is recovered and passed to a compressor 50 which is powered by a motor 52 of any suitable type to produce a pressure increase in the stream recovered through line 48 of about 50 to about 150 psi. This stream is then passed via a line 54 through heat exchanger 34 where it is cooled to a temperature from about −160 to about −225° F. at a pressure from about 75 to about 300 psig. At these conditions, this stream is liquid. This liquid steam is then readily pumped by pump 22 to a suitable pressure for delivery to a pipeline (typically about 800 to about 1200 psig) and discharged as a liquid stream through line 24. This stream is then vaporized by passing it through heat exchangers 26 and 30 which are connected by a line 28 to produce a conditioned natural gas in line 32 which is at about 800 to about 1200 psig and a temperature of from about 30 to about 50° F.

By this process, the natural gas separated in distillation tower 38 is reliquefied by use of compressor 50 and heat exchanger 34 so that the recovered gas from which NGLs have been removed is readily pumped by a pump for liquids to a pressure suitable for discharge to a pipeline or for other commercial use requiring a similar pressure. Clearly the process can be used to produce the product natural gas at substantially any desired temperature and pressure. The process accomplishes considerable efficiency by the ability to use a pump to pressurize the liquid natural gas from which the NGLs have been removed as a liquid rather than by requiring compression of a gas stream.

Figure 3:
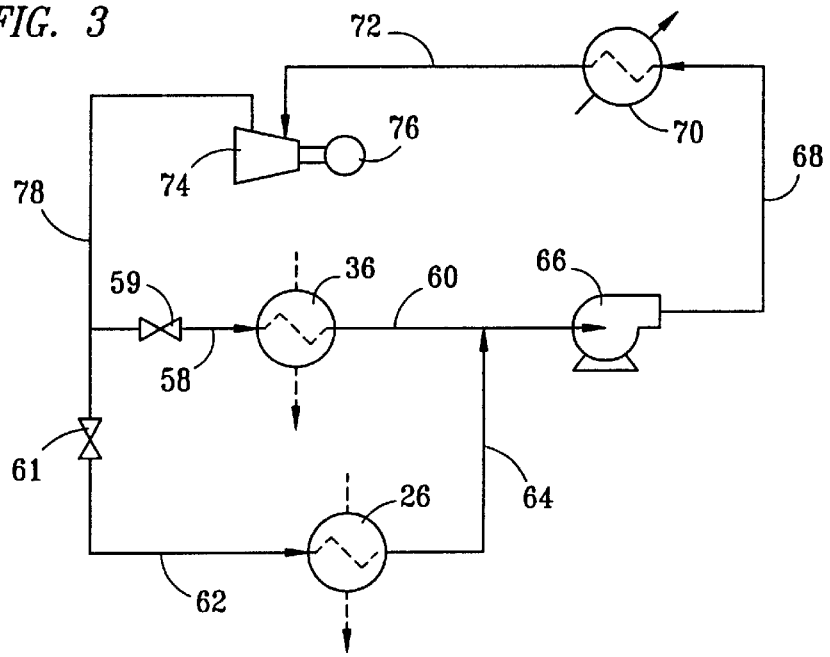
FIG. 3 discloses a closed loop energy generating system for use in connection with certain embodiments of the present invention.

In FIG. 3, a closed loop system is shown. This system is used with at least one of heat exchangers 26 and 36 as shown in FIG. 2. A gas heat exchange medium, which may be a light hydrocarbon gas, such as ethane or mixed light hydrocarbon gases, is passed at a temperature from about −100 to about −70° F. and a pressure from about 25 to about 75 psig through a line 78 to lines 58 and 62 and then to heat exchangers 36 and 26 respectively. In these heat exchangers both of which are used to heat liquid or semi-liquid light hydrocarbon streams, the gaseous stream charged through line 78 is converted into a liquid and is recovered through lines 60 and 64 at a temperature from about −70 to about −100° F. and at a pressure of about 25 to about 75 psig.

In essence, the heat exchange in heat exchangers 26 and 36 has heated the streams passed through heat exchanges 26 and 36 by the amount of latent heat required to condense the gaseous stream passed through line 78. This stream recovered from lines 60 and 64 is then passed to pump 66 where it is pumped to a pressure from about 250 to about 400 psig to produce a liquid stream which is passed to a heat exchanger 70 where it is heated to a temperature from about 0 to about 50° F. and is vaporized at a pressure from about 250 to about 400 psig. Heat exchanger 70 may be supplied with heat by air, water, a fired vaporizer or the like. The gaseous stream recovered from heat exchanger 70 via a line 72 is then passed to a turbo-expander 74, which drives an electric generator 76. The stream discharged from compressor 74 into line 78 is at the temperature and pressure conditions described previously. Alternatively, the heat exchange medium may be passed to one of heat exchangers 26 or 36 by use of valves 59 and 61 in lines 58 and 62, respectively, as shown in FIG. 4.

By the use of this closed loop heat exchange system, substantial electric power is generated by generator 76. The power generated approximates the entire power requirements for the operation of the process.

Figure 4:
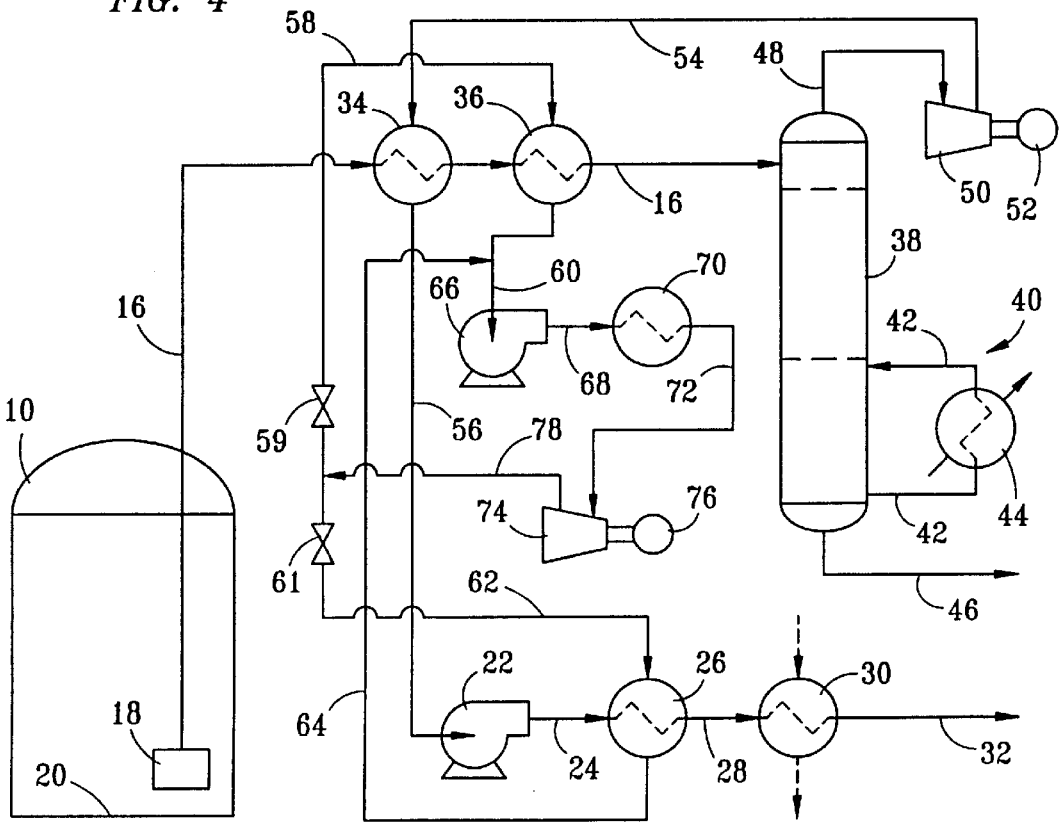
FIG. 4 discloses an embodiment of the process as shown in FIG. 1 including closed loop energy generating system shown in FIG. 3.

In FIG. 4, the closed loop process is as shown in FIG. 3, but is shown in combination with the process steps shown in FIG. 2. The temperature and pressure conditions previously shown are applicable to FIG. 4 as well, both for the closed loop system and for the other process steps. By the use of the process shown in FIG. 2, considerable efficiency is achieved in the conditioning of LNG for pipeline delivery or other commercial use. Specifically the NGL components are readily removed and by the use of the compression step with the overhead gas stream from distillation vessel 38, the recovered lighter gases after removal of the NGLs are readily liquefied and pumped to a desired pressure by the use of a pump rather than by compression of a gaseous stream to the elevated pressures required in pipelines. The ability to pressurize this stream as a liquid rather than as a gas is achieved primarily by the use of the compressor on the overhead gas stream from the distillation vessel in combination with the recycle of this stream for liquification by heat exchange with the LNG passed to distillation column 38.

In the variation of the process shown in FIG. 4, all these advantages are achieved and in addition, the use of the closed loop heat exchange/power generation system is shown to demonstrate the use of the closed loop system to generate power by use of the energy of the LNG stream. This process results in greater efficiency than the process shown in FIG. 2 since it results in the production of electrical power, which may be used for operation of the process. Even if sufficient power is not produced to operate the process, it results in greatly reducing the power demand from outside sources.

Figure 5:
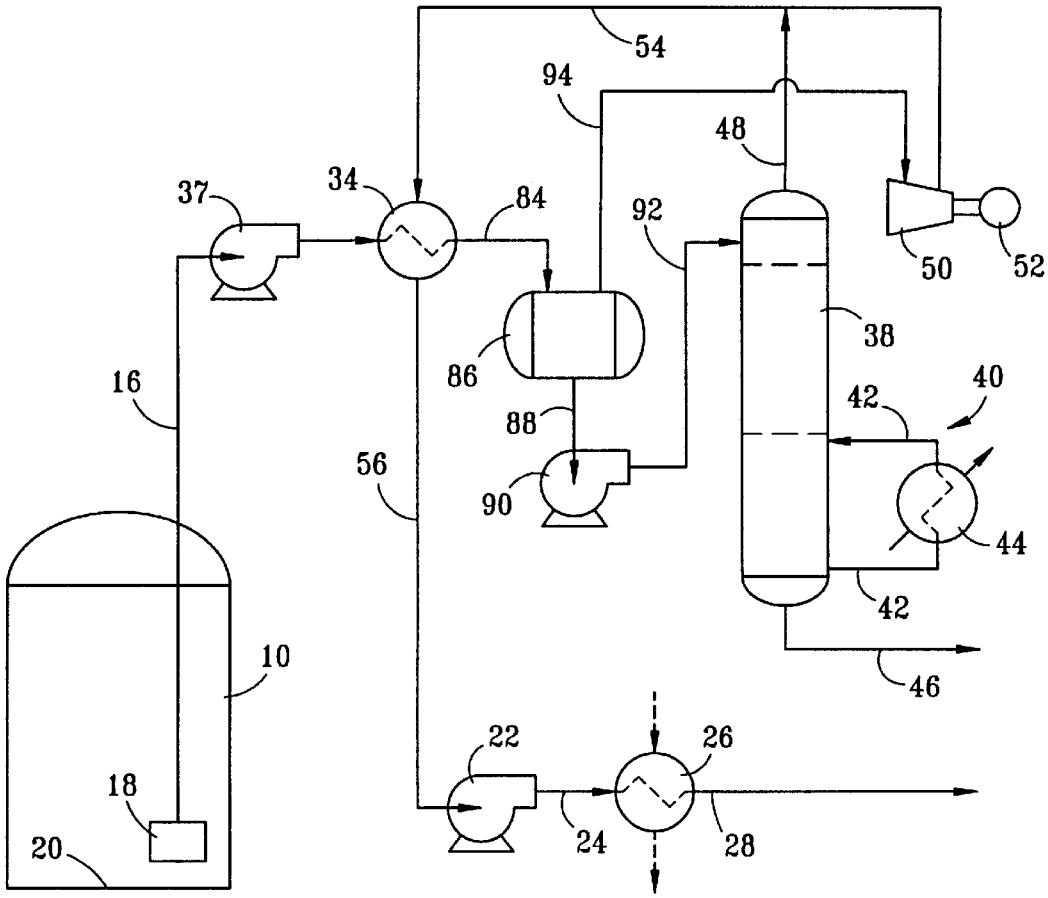
FIG. 5 shows an alternate embodiment of the present invention.
Figure 6:
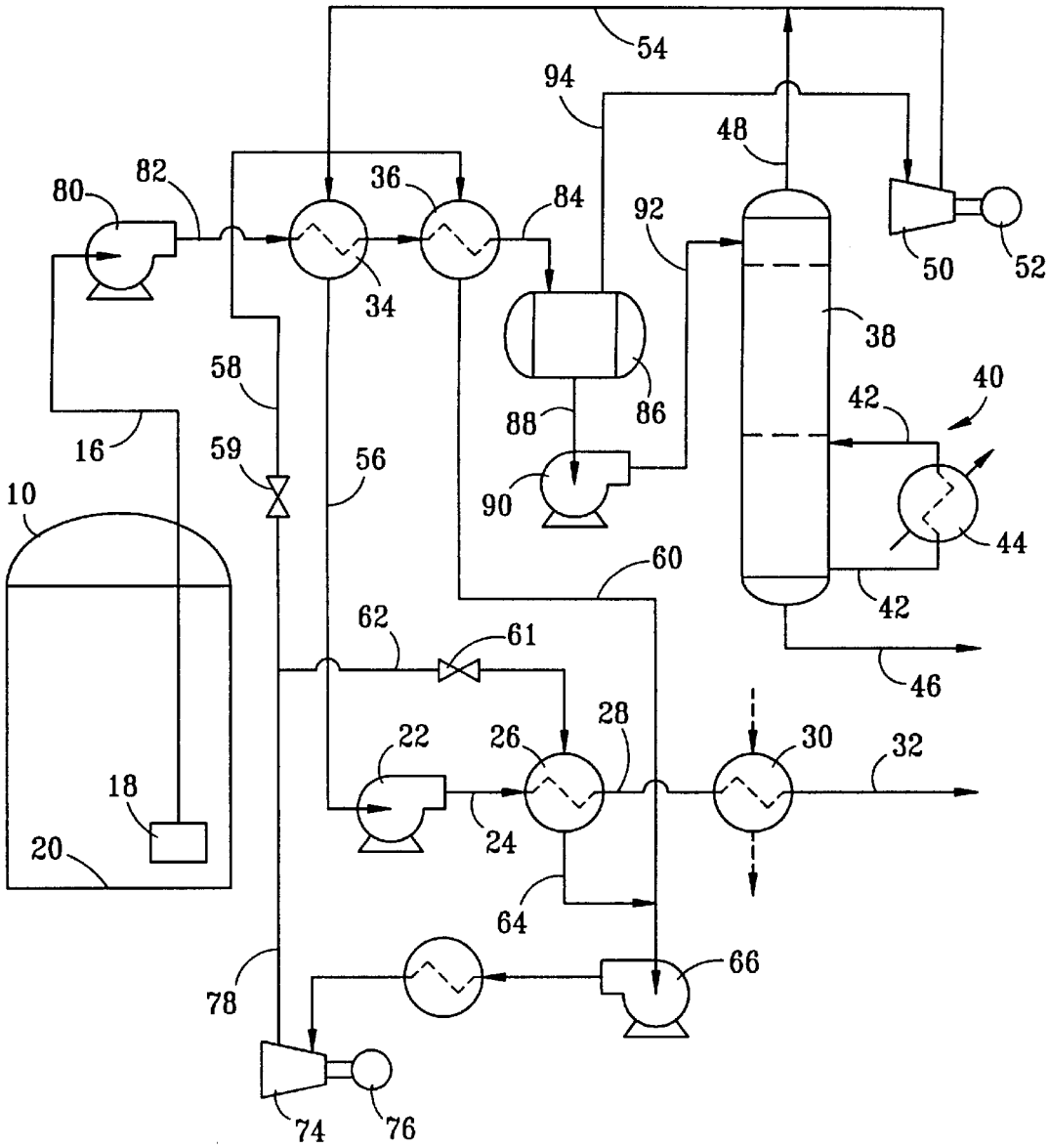
FIG. 6 discloses an embodiment of the process as shown in FIG. 5, including a closed loop energy generating system.

In FIG. 5, a variation of the present invention is shown. In this embodiment, the LNG is passed to a heat exchanger 34 (a second heat exchanger 36 as shown in FIG. 6 could also be used) from which it is discharged at a temperature of approximately −150 to about −190° F. and passed to a separation vessel 86 via a line 84. The overhead gas from separation vessel 86 is passed via a line 94 to compression in a compressor 50 wherein the pressure is increased by approximately 50 to 150 psi. The pressure in line 54 after compression in compressor 50 is typically from about 100 to about 300 psig. This enables the return of the gas from tank 86 via line 54 to heat exchanger 34 for liquefaction. The liquids recovered from separator 86 are passed via a line 88 to a pump 90 from which they are passed via a line 92 to distillation vessel 38. Distillation vessel 38 functions as described previously to separate NGLs, which are recovered through a line 46, and to produce an overhead gas stream, which comprises primarily the methane. This gaseous stream is recovered through a line 48 and passed to combination with the gas stream in line 54. The combined streams are then liquefied in heat exchanger 34 and are passed at a temperature of about −160 to about −225° F. at about 75 to about 300 psig to pump 22. Pump 22 discharges a liquid stream at a pressure suitable for discharge to a pipeline or for other commercial use through a line 24 with the liquid stream being vaporized in heat exchanger 26.

As discussed previously, heat exchanger 26 may be a fired heat exchanger or may be supplied with air, water or other suitable heat exchange material to vaporize the LNG stream. The vaporized stream is then discharged through a line 32 at suitable conditions for delivery to a pipeline or for other commercial use.

In FIG. 6, a variation of the process of FIG. 5 is shown where a closed loop system as described previously in conjunction with FIG. 3, is present. This closed loop system is used in conjunction with at lest one of heat exchangers 26 and 36. In this embodiment, two heat exchangers are used, i.e., heat exchangers 26 and 36, to vaporize the liquid stream in line 56. The conditioned natural gas is still produced at pipeline conditions but power is produced via generator 76 to assist in supplying the power requirements of the process. As noted previously, the closed loop system can be used with either or both of heat exchangers 26 and 36 by use of values 59 and 61, in lines 58 and 62, respectively.

As previously described, the process is more efficient than prior art processes in that it enables the compression of the natural gas after separation of the NGLs to a pressure suitable for discharge to a pipeline or the like as a liquid rather as a gaseous phase. Further, the use of the closed loop energy recovery system results in the recovery of substantial power values from the energy contained in the LNG stream.

The foregoing description of the equipment and process is considered to be sufficient to enable those skilled in the art to practice the process. Many features of various of the units have not been discussed in detail since units of this type are well known to those skilled in the art. The combination of features in the present invention results in substantial improvements in the efficiency of the process, both by reason of the compression of the separated gas stream from the distillation vessel and by reason of the power recovery by use of the closed loop system.

It is noted particularly in FIG. 2, that pump 37 is optional and in many instances may not be required at all. Specifically if the pressure in line 16 is sufficiently high, there will be no need for a pump 37.

Distillation vessel 38 is of any suitable type effective for achieving separation of components of different boiling points. The tower may be a packed column, may use bubble caps or other gas/liquid contacting devices and the like. The column is desirably of a separating capacity sufficient to result in separation of the natural gas liquids at a desired separation efficiency. Further, many of the temperatures and pressures discussed herein are related to the use of distillation vessel 38 to separate $C_2$+ NGLs. In some instances, it may be desirable to separate $C_3$+ NGLs and in some instances even $C_4$+ NGLs. While it is considered most likely that $C_2$+ NGLs will be separated, the process is sufficiently flexible to permit variations in the specific NGLs, which are to be separated. The separation of different NGL cuts could affect the temperatures recited above although it is believed that generally, the temperature and pressure conditions stated above will be effective with substantially any desired separation of NGLs.

It is also noted that the NGLs can vary substantially in different LNG streams. For instance, streams recovered from some parts of the world typically have about 3 to 9 weight percent NGLs contained therein. LNG streams from other parts of the world typically may contain as high as 15 to 18 weight percent NGLs. This is a significant difference and can radically affect the heating value of the natural gas. As a result, it is necessary, as discussed above, in many instances to either dilute the natural gas with an inert material or remove natural gas liquids from the LNG. Further, as also noted above, the removal of the NGLs results in the production of a valuable product since these materials frequently are of greater value as NGLs than as a part of the natural gas stream.

Having thus described the invention by reference to certain of its preferred embodiments, it is respectfully pointed out that the embodiments described are illustrative rather than limiting in nature and that many variations and modifications are possible within the scope of the present invention.

Having thus described the invention, I claim:

1. A method for vaporizing a liquefied natural gas, recovering natural gas liquids from the liquefied natural gas, and conditioning the liquefied natural gas for delivery to a pipeline or for commercial use, the method comprising:

a) vaporizing at least a major portion of a stream of the liquefied natural gas to produce an at least partially vaporized natural gas stream;

b) fractionating the at least partially vaporized natural gas stream to produce a gas stream and a natural gas liquids stream;

c) compressing the gas stream to increase the pressure of the gas stream by about 50 to about 150 psi to produce a compressed gas stream and cooling the vaporized stream by heat exchange with the stream of liquefied natural gas to produce a liquid stream;

d) pumping the liquid stream to produce a high-pressure liquid stream at a pressure from about 800 to about 1200 psig;

e) vaporizing the high-pressure liquid stream to produce a conditioned natural gas suitable for delivery to a pipeline or for commercial use; and f) recovering at least a portion of the natural gas liquids.

2. The method of claim 1 wherein the natural gas liquids comprise $C_2$+ hydrocarbons.

3. A method for vaporizing a liquefied natural gas, recovering natural gas liquids from the liquefied natural gas, conditioning the liquefied natural gas for delivery to a pipeline or for commercial use and producing power, the method comprising:

a) vaporizing at least a major portion of a stream of the liquefied natural gas to produce an at least partially vaporized natural gas stream;

b) fractionating the at least partially vaporized natural gas stream to produce a gas stream and a natural gas liquids stream;

c) compressing the gas stream to increase the pressure of the gas stream by about 50 to about 150 psi to produce a compressed gas stream and cooling the compressed gas stream by heat exchange with the stream of liquefied natural gas to produce a liquid stream;

d) pumping the liquid stream to produce a high-pressure liquid stream at a pressure from about 800 to about 1200 psig;

e) vaporizing the high-pressure liquid stream to produce a conditioned natural gas suitable for delivery to a pipeline or for commercial use;

f) recovering at least a portion of the natural gas liquids;

g) passing at least a one of a first portion and a second portion of a gas heat exchange fluid in heat exchange contact with at least one of the stream of liquefied natural gas and the high-pressure liquid stream to produce a liquid heat exchange fluid;

h) pumping the liquid heat exchange fluid to produce a higher-pressure liquid heat exchange fluid;

i) heating the higher-pressure liquid heat exchange fluid to vaporize the higher-pressure liquid heat exchange fluid to produce a higher-pressure gas heat exchange fluid;

j) driving an expander and electric power generator with the higher-pressure gas heat exchange fluid to produce electric power and the gas heat exchange fluid; and k) recycling the gas heat exchange fluid to heat exchange with the at least one of the stream of liquefied natural gas and the high-pressure liquid stream.

4. The method of claim 3 wherein the first portion of the gas heat exchange fluid is passed in heat exchange contact with the liquefied natural gas and wherein the second portion of the gas heat exchange fluid is passed in heat exchange contact with the high pressure liquid stream.

5. The method of claim 3 wherein the higher-pressure liquid heat exchange fluid is at a pressure from about 250 to about 400 psig.

6. The method of claim 3 wherein the gas heat exchange fluid is at a temperature from about −70 to about −100° F.

7. A method for vaporizing a liquefied natural gas, recovering natural gas liquids from the liquefied natural gas and conditioning the liquefied natural gas for delivery to a pipeline or for commercial use, the method comprising:

a) vaporizing at least a major portion of a stream of the liquefied natural gas to produce an at least partially vaporized natural gas stream;

b) separating the at least partially vaporized natural gas stream into a gas stream and a liquid stream;

c) compressing the gas stream to increase the pressure of the gas stream by about 50 to about 150 psi to produce a compressed gas stream;

d) fractionating the liquid stream at a pressure greater than the pressure of the compressed gas stream to produce an overhead gas stream and a natural gas liquids stream;

e) recovering at least a portion of the natural gas liquids;

f) combining the overhead gas stream with the compressed gas stream to produce a combined gas stream;

g) cooling the combined gas stream by heat exchange with the stream of liquefied natural gas to produce a liquid combined gas stream;

h) pumping the liquid combined gas stream to produce a high-pressure liquid stream at a pressure from about 800 to about 1200 psig; and, i) vaporizing the high-pressure liquid stream to produce a conditioned natural gas suitable for delivery to a pipeline or for commercial use.

8. The method of claim 7 wherein the natural gas liquids are $C_2$+ hydrocarbons.

9. The method of claim 7 wherein the conditioned natural gas stream is at a temperature from about 30 to about 50° F.

10. A method for vaporizing a liquefied natural gas, recovering natural gas liquids from the liquefied natural gas and conditioning the liquefied natural gas for delivery to a pipeline or for commercial use and electric producing power, the method comprising:

a) vaporizing at least a major portion of a stream of the liquefied natural gas to produce an at least partially vaporized natural gas stream;

b) separating the at least partially vaporized natural gas stream into a gas stream and a liquid stream;

c) compressing the gas stream to increase the pressure of the gas stream by about 50 to about 150 psi to produce a compressed gas stream;

d) fractionating the liquid stream at a pressure greater than the pressure of the compressed gas stream to produce an overhead gas stream and a natural gas liquid stream;

e) recovering natural gas liquids;

f) combining the overhead gas stream with the compressed gas stream to produce a combined gas stream;

g) cooling the combined gas stream by heat exchange with the stream of liquefied natural gas to produce a liquid combined gas stream;

h) pumping the liquid stream to produce a high-pressure liquid stream at a pressure from about 800 to about 1200 psig;

i) vaporizing the high-pressure liquid stream to produce a conditioned natural gas suitable for delivery to a pipeline or for commercial use;

j) passing at least one of a first portion and a second portion of a gas heat exchange fluid in heat exchange contact with at least one of the liquefied natural gas stream and the high-pressure liquid stream to produce a liquid heat exchange fluid;

k) pumping the liquid heat exchange fluid to produce a high-pressure liquid heat exchange fluid;

l) heating the higher-pressure liquid heat exchange fluid to a temperature to vaporize the higher-pressure liquid heat exchange fluid to produce a higher pressure gas heat exchange fluid;

m) driving an expander and electric power generator with the higher-pressure heat exchange fluid to produce electric power and the gas heat exchange fluid; and, n) recycling the gas heat exchange fluid to heat exchange with the at least one of the liquefied natural gas stream and the high-pressure liquid stream.

11. The method of claim 10 wherein the first portion of the gas heat exchange in heat exchange contact with the liquefied natural gas and wherein the second portion of the gas heat exchange fluid is passed in heat exchange contact with the high-pressure liquid stream.

12. The method of claim 10 wherein the heat exchange fluid is ethane.

13. A system for vaporizing a liquefied natural gas stream, recovering natural gas liquids from the liquefied natural gas and conditioning the liquefied natural gas for delivery to a pipeline or for commercial use, the system comprising:

a) a liquefied natural gas inlet line in fluid communication with a liquefied natural gas source and a first heat exchanger;

b) a distillation column in fluid communication with the first heat exchanger and having a gas outlet and a natural gas liquids outlet;

c) a compressor in fluid communication with the gas outlet and a compressed gas outlet;

d) a line in fluid communication with the compressed gas outlet and the first heat exchanger; and e) a pump in fluid communication with the first heat exchanger and a second heat exchanger.

14. The system of claim 13 wherein the system further compresses a closed loop system in heat exchange contact with at least one of the second heat exchanger and a third heat exchanger in heat exchange contact with the liquefied natural gas stream and adapted to heat natural gas streams in the at least one of the second and third heat exchangers and produce electrical power.

15. The system of claim 14 wherein the closed loop system comprises a first closed loop system line in fluid communication with at least one of the second heat exchanger and the third heat exchanger and a closed loop system pump, a second closed loop system line in fluid communication with the closed loop system pump and a closed loop system heat exchanger adapted to heat a closed loop system heat exchange fluid, a third closed loop system line in fluid communication with the closed loop system heat exchanger and a turbo-expander, the turbo-expander being operatively connected to an electric power generator, and having an outlet, the outlet being in fluid communication with the first closed system line.

16. The system of claim 15 wherein the first closed loop system line is in fluid communication with both the second heat exchanger and the third heat exchanger.

17. A system for vaporizing a liquefied natural gas stream, recovering natural gas liquids from the liquefied natural gas and conditioning the liquefied natural gas for delivery to a pipeline or for commercial use, the system comprising:

a) a liquefied natural gas inlet line in fluid communication with a liquefied natural gas source and a first heat exchanger having a heated liquefied natural gas outlet;

b) a separator vessel in fluid communication with the first heat exchanger and having a separator gas outlet and a liquids outlet;

c) a pump in fluid communication with the liquids outlet and having a high-pressure liquid outlet;

d) a distillation column in fluid communication with the high-pressure liquid outlet from the pump and having an overhead gas outlet natural gas liquids outlet;

e) a compressor in fluid communication with the separator gas outlet and a compressed gas outlet;

f) a line in fluid communication with the compressed gas outlet and the overhead gas outlet to combine the compressed gas and the overhead gas to produce a combined stream and to pass the combined stream to the first heat exchanger to produce a high-pressure combined gas liquids stream; and having a high-pressure combined gas liquids outlet; and, g) a pump in fluid communication with the high-pressure combined gas liquids outlet and a second heat exchanger the second heat exchanger being adapted to at least partially vaporize the high-pressure combined gas liquids stream.

18. The system of claim 17 wherein the system further comprises a closed loop system in heat exchange contact with at least one of the second exchanger and a third heat exchanger in heat exchange contact with the liquefied natural gas stream and adapted to heat a natural gas stream in at least one of the second heat exchanger and third heat exchanger and produce electrical power.

19. The system of claim 18 wherein the closed loop system comprises a first closed loop system line in fluid communication with the second heat exchanger and a closed loop system pump, a second closed loop system line in fluid communication with the closed loop system pump and a closed loop system heat exchanger adapted to heat a closed loop system heat exchanger fluid, a third closed loop system line in fluid communication with the closed loop system heat exchanger and a turbo-expander, the turbo-expander being operatively connected to an electric power generator, and having an outlet, the outlet being in fluid communication with the first closed loop system line.

20. The system of claim 19 wherein the system further comprises a third heat exchanger in fluid communication with the second heat exchanger to vaporize the high-pressure combined gas liquid stream.

* * * * *